US009914577B2

(12) United States Patent
Meng et al.

(10) Patent No.: US 9,914,577 B2
(45) Date of Patent: Mar. 13, 2018

(54) PACKAGING ASSEMBLY

(71) Applicants: BOE TECHNOLOGY GROUP CO., LTD., Beijing (CN); BEIJING BOE MULTIMEDIA TECHNOLOGY CO., LTD., Beijing (CN)

(72) Inventors: Xianlei Meng, Beijing (CN); Jianbin Gao, Beijing (CN)

(73) Assignees: BOE TECHNOLOGY GROUP CO., LTD., Beijing (CN); BEIJING BOE MULTIMEDIA TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/906,418

(22) PCT Filed: Aug. 18, 2015

(86) PCT No.: PCT/CN2015/087335
§ 371 (c)(1),
(2) Date: Jan. 20, 2016

(87) PCT Pub. No.: WO2016/127617
PCT Pub. Date: Aug. 18, 2016

(65) Prior Publication Data

US 2016/0368691 A1 Dec. 22, 2016

(30) Foreign Application Priority Data

Feb. 11, 2015 (CN) ..... 2015 2 0099091 U

(51) Int. Cl.
*B65D 81/113* (2006.01)
*B65D 85/48* (2006.01)
*B65D 81/05* (2006.01)

(52) U.S. Cl.
CPC ..... *B65D 81/113* (2013.01); *B65D 81/057* (2013.01); *B65D 85/48* (2013.01); *B65D 2585/6837* (2013.01)

(58) Field of Classification Search
CPC .... B65D 81/05; B65D 81/057; B65D 81/113; B65D 85/48; B65D 2585/6837;
(Continued)

(56) References Cited

U.S. PATENT DOCUMENTS 2,674,433 A * 4/1954 Mautner ..... B65D 81/07 206/586
6,899,946 B2 * 5/2005 Geary ..... B65D 71/04 206/586
(Continued)

FOREIGN PATENT DOCUMENTS

CA 2886599 A1 * 4/2014 ..... B65D 81/055
CN 101426696 A 5/2009
(Continued)

OTHER PUBLICATIONS

International Search Report dated Nov. 11, 2015 issued in corresponding International Application No. PCT/CN2015/087335 along with an English translation of the Written Opinion of the International Searching Authority.

*Primary Examiner* — Bryon Gehman
(74) *Attorney, Agent, or Firm* — Nath, Goldberg & Meyer; Joshua B. Goldberg

(57) ABSTRACT

The present subject matter provides a packaging assembly. The packaging assembly includes an inner protection layer which fits and is in contact with a surface of an object to be packaged, and an outer protection layer which covers the inner protection layer. The materials of the outer protection layer and the inner protection layer have different elastic coefficients.

7 Claims, 3 Drawing Sheets

(58) Field of Classification Search
CPC .... B65D 81/053; B65D 81/055; B65D 81/07; B65D 81/36; B65D 81/361
USPC ..... 206/453, 521–523, 583–594
See application file for complete search history.

(56) References Cited

U.S. PATENT DOCUMENTS

| | | | | |
|---|---|---|---|---|
| 7,828,151 | B2 * | 11/2010 | Murdoch | B65D 81/053 206/453 |
| 8,991,601 | B2 * | 3/2015 | Torikai | B65D 25/103 206/453 |
| 2014/0014549 | A1 * | 1/2014 | Zhao | B65D 85/30 206/453 |

FOREIGN PATENT DOCUMENTS

| | | | | |
|---|---|---|---|---|
| CN | 202897204 | U | 4/2013 | |
| CN | 204433395 | U | 7/2015 | |
| KR | 20-2012-0006208 | U | 9/2012 | |
| WO | WO 2012117740 | A1 * | 9/2012 | B65D 81/055 |

* cited by examiner

FIG. 1 – PRIOR ART --
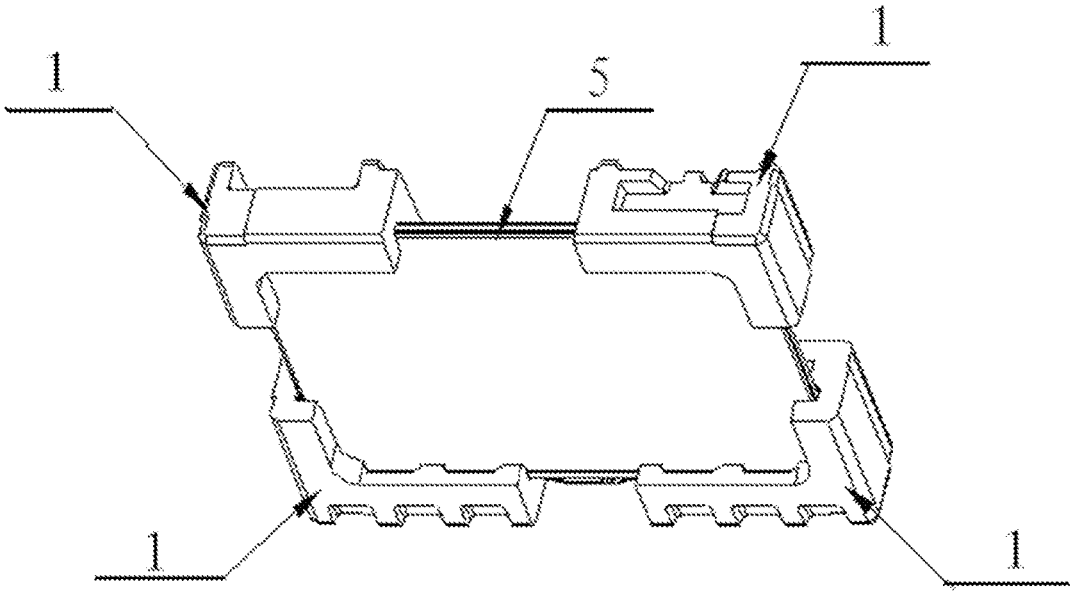
FIG. 2 – PRIOR ART --
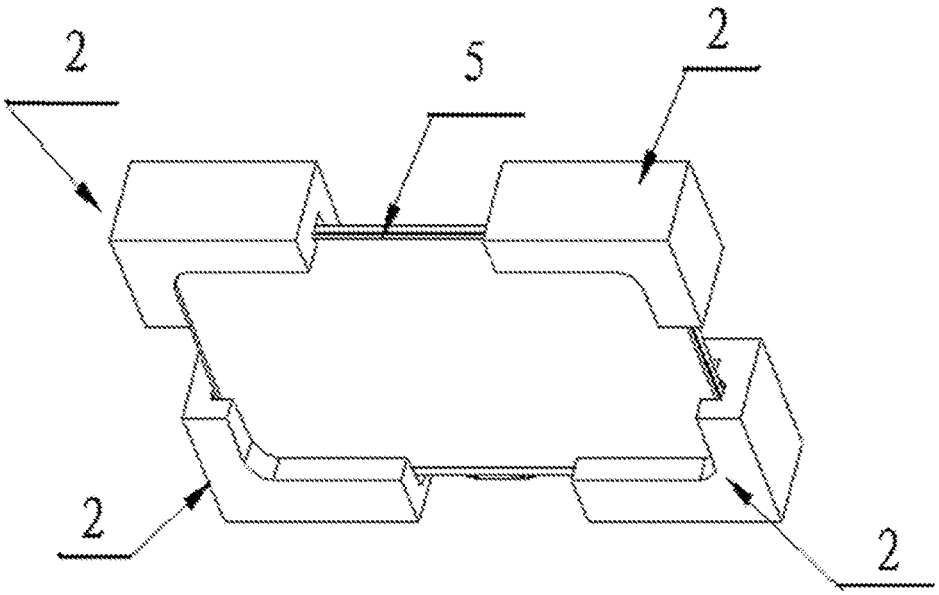

PACKAGING ASSEMBLY

This is a National Phase Application filed under 35 U.S.C. 371 as a national stage of PCT/CN2015/087335, filed Aug. 18, 2015, an application claiming the benefit of Chinese Application No. 201520099091.9, filed Feb. 11, 2015, the content of each of which is hereby incorporated by reference in its entirety.

FIELD OF THE INVENTION

The present invention relates to the technical field of package, and specifically relates to a packaging assembly.

BACKGROUND OF THE INVENTION

In the modern logistics, it has been focused on the problem, in the field of package, of how to package transportation objects so as to ensure the safety and intactness of the same during the transportation. With the development of modern logistics, the types of transportable objects increase, and objects of different types have different requirements on package. For example, in the case that the transportation object is a liquid crystal display (LCD) television, the film material of the television may be scratched or the screen may be deformed or even cracked due to the vibration or dropping of the object or collision with other object(s) during the transportation, so a package needs to be used to provide sufficient cushioning protection for the television to prevent it from being hurt during the transportation. In the case that the transportation object is an object made of high-density material, for example, a steel plate, such object may collide with or damage other object(s) if it drops during the transportation, so a package member needs to be used to provide sufficient cushion to prevent it from damaging other object(s).

In conventional packaging means, package members with the same cushioning ability are used alone. Taking the package member for packaging a LCD television for instance, the conventional packaging means mainly include a Polystyrene (Expandable Polystyrene, EPS) package member 1 as shown in FIG. 1, and a pearl wool (Expandable Polyethylene, EPE) package member 2 as shown in FIG. 2.

In the case of using the EPS package member 1 alone, the EPS package member 1, due to its weak cushioning ability, cannot provide sufficient protection to the object to be packaged without increasing the size thereof. In order to provide sufficient cushioning protection, the size of the package member needs to be increased, which, however, increases the space occupied by the package member, and is unfavorable to the product storage and transportation in practical logistics. In the case of using the EPE package member 2 alone, although the EPE package member 2 can provide sufficient protection without increasing the size thereof, the EPE material is expensive and the cost for packing a product is high, and thus it is not suitable for product packaging in mass production.

In addition, when the object to be packaged is not limited to a LCD television, for example, when the object to be packaged has large density and readily damages other object(s), the conventional means of using package members with the same cushioning ability alone cannot facilitate to provide sufficient protection to prevent the object to be packaged from damaging others.

Therefore, how to package various types of objects to be packaged to provide sufficient protection during the transportation while maintaining low packaging costs so as to be applicable to the practical manufacture becomes a new challenge in the field of production packaging.

SUMMARY OF THE INVENTION

In order to solve the above problem, the present invention provides up assembly, which comprises: an inner protection layer which fits and is in contact with a surface of an object to be packaged, and an outer protection layer which covers the inner protection layer, wherein materials of the outer protection layer and the inner protection layer have different elastic coefficients.

In the case that the object to be packaged is a rigid object or other object possibly damaging object(s) in the surroundings, the elastic coefficient of the outer protection layer may be smaller than that of the inner protection layer no as to prevent the object to be packaged from damaging other object(s) during the transportation.

In the case that the object to be packaged is vulnerable, such as being fragile, deformable or the like, the elastic coefficient of the outer protection layer may be larger than that of the inner protection layer so as to prevent the object to be packaged from being damaged during the transportation. In this case, the outer protection layer may include Expandable Polystyrene, and the inner protection layer may include Expandable Polyethylene.

The inner protection layer and the outer protection layer covering thereon may be formed integrally.

The inner protection layer may be connected with the outer protection layer covering thereon.

The outer protection layer may constitute an outer package member of the packaging assembly, which comprises two clamping parts facing to each other and the clamping parts are configured to clamp two opposite side surfaces of the object to be packaged; the inner protection layer may constitute an inner lining member of the packaging assembly, which is provided on inner wall, configured to clamp a side surface of the object to be packaged, of at least one clamping part of the outer package member.

Preferably, the inner lining member may be provided on the inner walls of both clamping parts of the outer package member.

Preferably, the outer package member may further include a connecting part, which connects the clamping parts and forms an accommodation groove together with the clamping parts, and the accommodation groove is configured to accommodate a part of the object to be packaged.

Preferably, the accommodation groove may have a shape that fits each side or angle to be protected of the object to be packaged.

Preferably, the inner lining member may be provided on inner wall of the connecting part, and a part of the inner lining member provided on the inner wall of the connecting part and a part of the inner lining member provided on the inner walls of the clamping parts may be formed integrally.

The inner walls of the two clamping parts of the outer package member may have different areas.

An area of the inner lining member may be equal to or less than that of an overlapping portion between the clamping parts of the outer package member and the object to be packaged.

The present invention provides a packaging assembly, which comprises an outer protection layer and an inner protection layer, wherein the outer protection layer and the inner protection layer have different elastic coefficients. The packaging assembly can provide sufficient protection to various types of objects to be packaged and maintain low packaging cost, which satisfies the requirement for packaging the transportation objects in mass production during the transportation.

BRIEF DESCRIPTION OF THE DRAWINGS

FIG. 1 is a structural schematic diagram of using a Polystyrene package member alone for packaging in the prior art;

FIG. 2 is a structural schematic diagram of using a pearl wool package member alone for packaging in the prior art;

REFERENCE NUMERALS

Figure 3A:
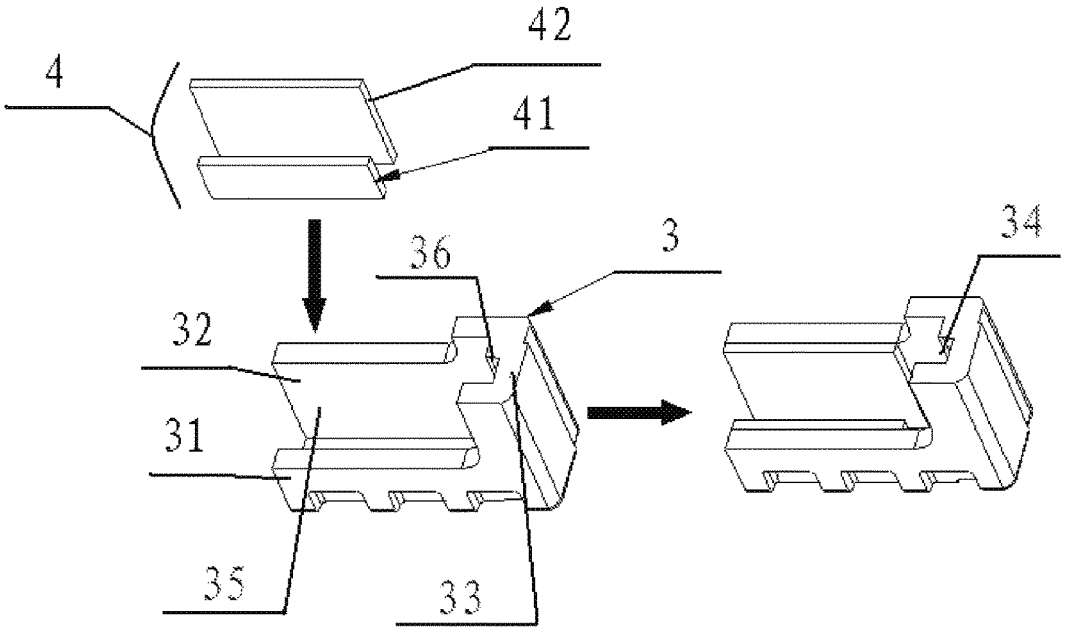
FIG. 3(*a*) and FIG. 3(*b*) are structural schematic diagrams of a packaging assembly according to embodiments of the present invention.

1. Polystyrene package member;

2. Pearl wool package member;

3. outer package member; 31. front clamping part; 32. back clamping part; 33. connecting part; 34. accommodation groove; 35. inner wall of the clamping part; 36. inner wall of the connecting part;

4. inner lining member; 41. front inner lining member; 42. front inner lining member; 43. part of the inner lining member provided on the inner wall of the connecting part;

5. object to be packaged.

DETAILED DESCRIPTION OF THE EMBODIMENTS

To make those skilled in the art better understand the technical solutions of the present invention, a packaging assembly of the present invention will be further described in detail below in conjunction with the accompanying drawings and specific implementations of the embodiments.

In an exemplary embodiment of the present invention, there is provided a packaging assembly, the packaging assembly comprising: an inner protection layer which fits and is in contact with a surface of an object to be packaged, and an outer protection layer which covers the inner protection layer, wherein materials of the outer protection layer and the inner protection layer have different elastic coefficients.

For example, in the case that the object to be packaged is spheral, the inner protection layer of the packaging assembly according to the exemplary embodiment is a sphere-like layer contacting with the surface of the spheral object, and in the case that the object to be packaged is an object (e.g., a trophy) of a particular irregular shape, the inner protection layer of the packaging assembly according to the exemplary embodiment directly contacts with the outer surface of the object and has the same shape as the outer surface of the object.

In an exemplary embodiment of the present invention, outer surfaces of the inner protection layer and the outer protection layer may have different shapes. For example, in the case that the object to be packaged is spheral, the outer surface of the inner protection layer may be sphere-like, while the outer protection layer may have an outer surface that can form a cube.

In an exemplary embodiment of the present invention, in the case that the object to be packaged is a rigid object or other object possibly damaging other object(s) in the surroundings, such as a steel plate or a short, the elastic coefficient of the outer protection layer of the packaging assembly may be smaller than that of the inner protection layer so as to prevent the object to be packaged from damaging others during the transportation.

In an exemplary embodiment of the present invention, in the case that the object to be packaged is a fragile or deformable object, such as a LCD television, a glass product etc., the elastic coefficient of the outer protection layer may be larger than that of the inner protection layer so as to prevent the object to be packaged from being damaged during the transportation.

For a packaging assembly according to the exemplary embodiments of the present invention, in the case that the elastic coefficient of the outer protection layer is larger than that of the inner protection layer, the outer protection layer may include Expandable Polystyrene, and the inner protection layer may include Expandable Polyethylene. Since the Expandable Polystyrene material has a weak cushioning ability but has a low price, it facilitates maintaining relatively low cost of the packaging assembly when being used as the material of the outer protection layer. Since Expandable Polyethylene has an excellent cushioning ability but has an expensive price, it can provide sufficient cushioning protection to the object to be packaged while maintaining relatively low packaging cost when being used as the material of the inner protection layer that fits and is in contact with the object to be packaged.

In an exemplary embodiment of the present invention, the inner protection layer may completely cover the entire outer surface of the object to be packaged so as to provide sealing protection to the object to be packaged. For example, in the case that the object to be packaged is spheral, the inner protection layer is formed to two parts with hemisphere shape, and the objected to be packaged can be sealed therein by assembling the two hemisphere-shaped parts with the inner surfaces thereof facing each other.

In an exemplary embodiment of the present invention, the inner protection layer may cover a part of the outer surface of the object to be packaged which needs to be protected, so as to decrease the cost of the packaging assembly. For example, in the case that the object to be packaged is plate-like, the inner protection layer may cover the sides or angles of the object to be packaged only and does not need to seal the object to be packaged therein.

In an exemplary embodiment of the present invention, the inner protection layer may be connected with the outer protection layer. The inner protection layer may be connected with the outer protection layer in various ways. For example, the inner protection layer may be adhered to the inner surface of the outer protection layer by using double faced adhesive tape or the like; alternatively, a groove may be provided in the outer protection layer and a protrude matching with the groove may be provided at the corresponding position of the inner protection layer, and thereby the inner protection layer may be connected with the outer protection layer by inserting the protrude of the inner protection layer into the groove of the outer protection layer. It should be understood that the inner protection layer may be connected with the outer protection layer in other ways in the prior art.

Particularly, the outer protection layer and the inner protection layer may be formed integrally to connect the inner protection layer with the outer protection layer. The outer protection layer and the inner protection layer may be formed integrally with the same material, and the elastic coefficient of the material is gradually changed by controlling the temperature of the material during the formation, such that the outer protection layer and the inner protection layer with different elastic coefficients are formed integrally.

Figure 3B:
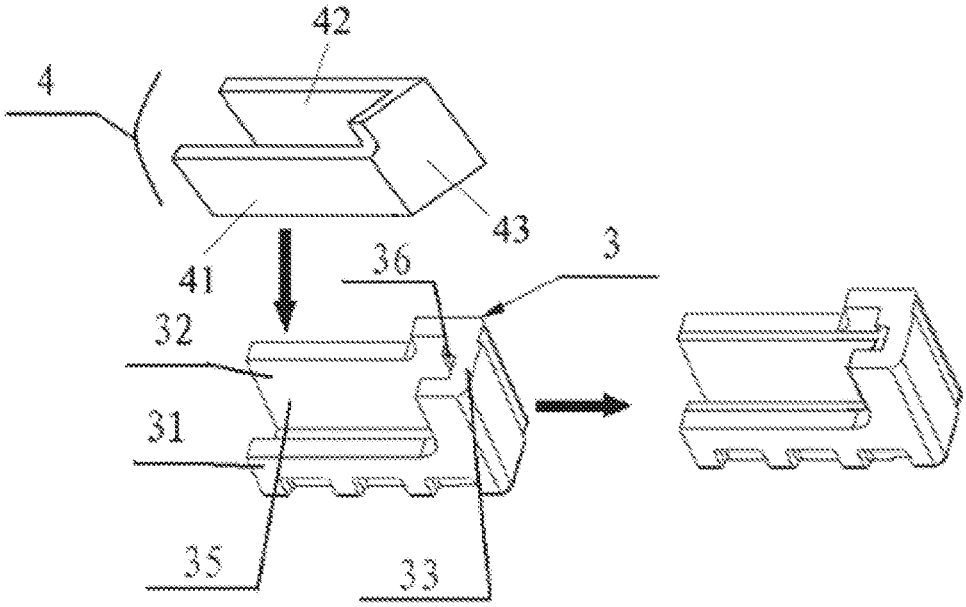
Figure 4:
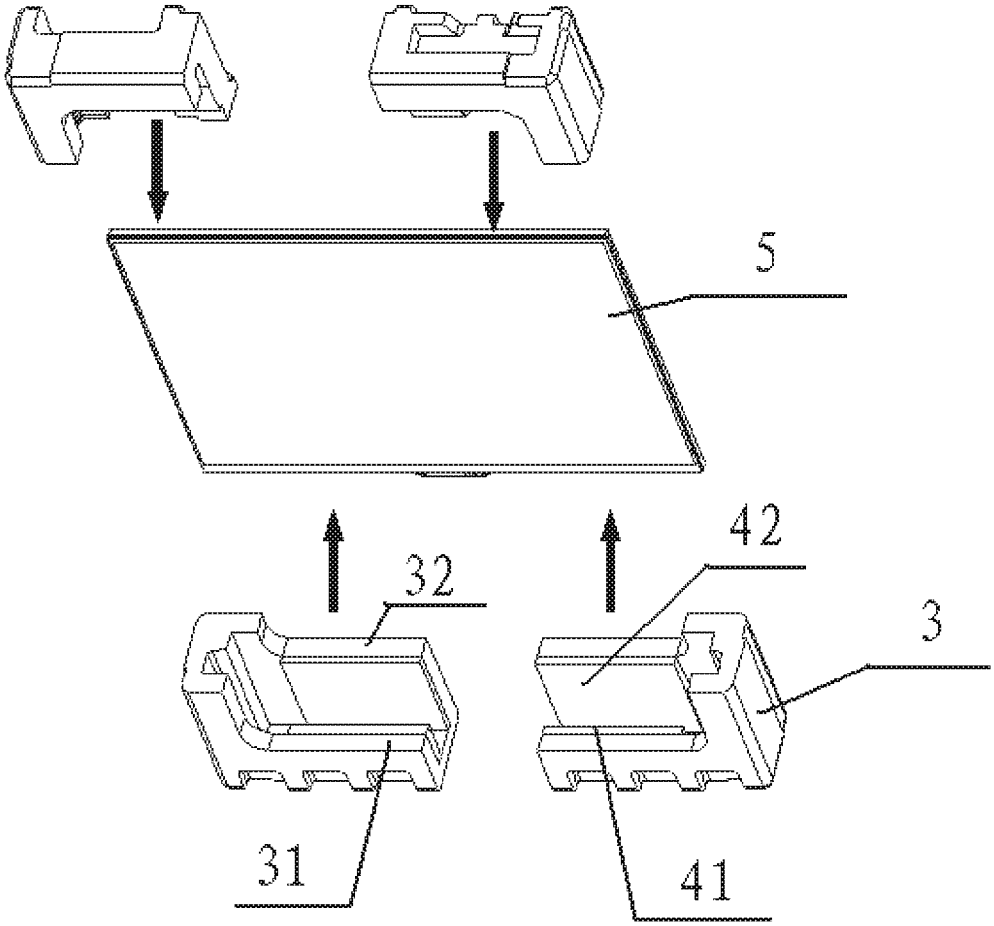
FIG. 4 is a schematic diagram of packaging an object to be packaged by using a packaging assembly according to embodiments of the present invention.

Preferably, with reference to FIGS. 3 and 4, in an exemplary embodiment of the present invention, the outer protection layer may constitute an outer package member 3 of the packaging assembly, which comprises two clamping parts (i.e., front clamping part 31 and back clamping part 32) facing to each other and is configured to clamp two opposite side surfaces of the object to be packaged, and the inner protection layer may constitute an inner lining member 4 of the packaging assembly, which is provided on the inner wall, configured to clamp aside surface of the object to be packaged, of at least one clamping part of the outer package member. In other words, the packaging assembly according to the exemplary embodiment of the present invention includes the outer package member 3 and the inner lining member 4.

For example, in the case that the object to be packaged is plate-like, the outer package member 3 according to the exemplary embodiment of the present invention clamps the object to be packaged through the front clamping part 31 and the back clamping part 32, and the inner lining member 4 is provided on at least one clamping part.

For example, in the case that the object to be packaged is a plate-like object that is fragile and deforms easily, such as a LCD display, the elastic coefficient of the inner lining member 4 is larger than that of the outer package member 3. Compared with both cases where a package member with small elastic coefficient, e.g., a Polystyrene package member 1, is used alone and where a package with large elastic coefficient e.g., a pearl wool package member 2; is used alone in the prior art, the packaging assembly in the exemplary embodiments provides sufficient cushioning protection to the object to be packaged without increasing the size of the package member and maintains relatively low packaging cost, which satisfies the requirement for packaging in mass production.

Preferably, the inner lining members 4 are provided on the inner walls 35 of both clamping pails of the outer package member 3 (the inner wall of the front clamping part 31 is not shown in FIG. 3(*a*) and FIG. 3(*b*)), and are referred to as front inner lining member 41 and back inner lining member 42, respectively. With the two inner lining members 4 provided in such way, the cushioning ability of the packaging assembly can be improved.

According to an exemplary embodiment of the present invention, in the case that the objects to be packaged have the same shape but various thicknesses, the outer package member 3 may be made as a general component, and it can fit the objects to be packaged with various thicknesses by replacing the inner lining member 4 connecting to its inner wall. For example, the inner lining member 4 may be slice-like, and for a series of objects to be packaged with the same shape and various thicknesses, the packaging assemblies applicable thereto according to exemplary embodiments of the present invention may be implemented only by changing the thickness of the inner lining member 4, without changing the outer package member 3, so as to save the cost of a mould used to form the outer package member 3, which helps to maintain low packaging cost.

Preferably, the outer package member 3 may further include a connecting part 33 which connects the clamping parts and form an accommodation groove together with the clamping parts, the accommodation groove is configured to accommodate a part of the object to be packaged. The accommodation groove may have a shape that fits the periphery profile of the object to be packaged so as to further clamp or secure the object to be packaged.

Preferably, the inner wall 36 of the connecting part may be provided with the inner lining member 4, for example, the inner lining member 43 shown in FIG. 3(*b*). The inner lining member 43 may provide a buffer against the collision to the object to be packaged 5 caused by an external force in a direction perpendicular to the inner wall 36 of the connecting part, thereby providing full protection to the object to be packaged 5. The inner lining member 43 may be connected to the inner wall 36 of the connecting part 33 in various ways as described above.

Preferably, as shown in FIG. 3(*b*), the front inner lining member 41, the back inner lining member 42 and the inner lining member 43 provided on the inner wall of the connecting part may be formed integrally. In this case, when the object to be packaged 5 is collided by an external force in a direction perpendicular to the outer walls of the clamping parts 31 and 32, and due to the integration of the front inner lining member 41, the back inner lining member 42 and the inner lining member 43 provided on the inner wall of the connecting part, a part of the external force may be transferred to a surface of the object to be packaged 5 which is in contact with the inner lining member 43 through the connecting part 33 of the outer package member and the inner lining member 43, thereby reducing the stress applied to the surfaces of the object to be packaged 5 which are in contact with the inner lining members 41 and 42. Similarly, when the object to be packaged 5 is collided by an external force in a direction perpendicular to the inner wall 36 of the connecting part, a part of the external force may be transferred to the surfaces of the object to be packaged 5 which are in contact with the inner lining members 41 and 42 through the clamping parts 31 and 32 of the outer package member and the inner lining members 41 and 42, thereby reducing the stress applied to the surface of the object to be packaged 5 which is in contact with the inner lining member 43. In this way, the ability of cushioning an external three in a particular direction is improved by the integrated inner lining member 4.

Preferably, the area of the inner lining member 4 (or 42) may be equal to or smaller than that of the overlapping portion between the front clamping part (or back clamping part) of the outer package member 3 and the object to be packaged. For example, in the case that the object to be packaged is a LCD television 5, the area of the overlapping portion between the two clamping parts and the object to be packaged refers to an area of the overlapping portion between the two clamping parts and the display panel of the LCD television 5 in a direction perpendicular to the display panel.

It should be understood that the inner lining member 4 may be provided according to specific conditions. For an object which is very easy to be damaged, the inner lining member 4 may be provided on the entire inner walls of the two clamping parts; for an object which is relatively hard to be damaged, the inner lining member 4 may be provided only on a part of the inner walls 35 of the two clamping parts. In this case, the cost of moulds due to the replacement of the inner lining members 4 may be further decreased when the outer package member 3 is made as a general component as mentioned above, thereby saving the cost of the packaging assembly while providing sufficient cushioning effect.

Preferably, the shape of the accommodation groove 34 fits the sides and angles to be protected of the object to be packaged.

It should be understood that the object to be packaged may have a rectangular shape. In the case that the object to be packaged is a rectangular-shaped object such as a LCD television, a tablet PC, a display screen, plate glass or the like, the four angles of the object to be packaged are most likely to be collided by an external force in practice, therefore, the packaging assembly may be mainly provided at the four angles of the rectangular-shaped object, and the accommodation groove 34 of the outer package member 3 is formed to fit the angles of the rectangular-shaped object, as shown in FIG. 4; the packaging assembly may also be provided at a side of the rectangular-shaped object such that the accommodation groove 34 of the outer package member fit the side, and the specific setting may be adjusted with respect to the actual requirement. It should be understood that the object to be packaged and the outer package member fitting its sides and angles in FIG. 4 are merely illustrative, and in the case that the packaging assembly comprises an outer package member and an inner lining member, the object to be packaged according to the exemplary embodiments is not limited to have rectangle shape, but may have any enclosed polygonal shape with three or more angles, and the shape of the corresponding accommodation groove of the outer package member depends on the shape of the sides or angels to be protected of the specific object to be packaged.

It should be understood that, the two clamping parts of the outer package member 3 are provided to effectively clamp the object to be packaged. Therefore, the shape of clamping parts may be designed according to the appearance of the object to be packaged and is not limited herein.

Preferably, the areas of inner walls 35 of the two clamping parts of the outer package member 3 may not be equal. For example, as shown in FIG. 3(*a*) and FIG. 3(*b*), the area of the inner wall of the front clamping part 31 is smaller than that of the inner wall of the back clamping part 32. In the case that the object to be packaged 5 is a LCD television, the inner wall of the back clamping part 32 contacts with the non-display surface of the LCD television and the inner wall of the front clamping part 31 contacts with the display surface of the LCD television. Since the area of the inner wall of the front clamping part 31 is small while the area of inner wall of the back clamping part 32 is large, such outer package member 3 not only can reduce possible damage to the display surface of the LCD television, but also can provide sufficient cushioning ability. It should be understood that the term "contact" can indicate not only the case that the inner wall of the clamping part with no inner lining member provided thereon directly contact with the object to be packaged, but also the case that the inner wall of the clamping part contact with the object to be packaged through the inner lining member.

Although both the outer package members shown in FIGS. 3 and 4 comprise clamping parts and a connecting part which connects the two clamping parts and the packaging assembly is fixed onto the object to be packaged through the accommodation groove formed between the connecting part and the clamping parts, the packaging assembly according to the exemplary embodiments of the present invention may merely comprises two clamping parts not connected with each other. In this case, the clamping parts of the outer package member and the inner lining member provided on the inner wall of the clamping part are fixed onto the object to be packaged by an external force, for example, by means of binding the packaging assembly, or using a packing container clinging to the packaging assembly to fix it, so as to protect the object to be packaged.

It can be understood that the foregoing implementations are merely exemplary implementations used for describing the principle of the present invention, but the present invention is not limited thereto. Those of ordinary skill in the art may make various variations and improvements without departing from the spirit and essence of the present invention, and these variations and improvements shall fall into the protection scope of the present invention.

What is claimed is:

1. A packaging assembly for protecting a plate-shaped member, wherein the packaging assembly is a corner projector for protecting a corner part of the plate-shaped member, and the packaging assembly comprises:

an outer package member comprising a pair of clamping parts and a pair of connecting parts, the pair of the clamping parts being configured to clamp two opposite side surfaces of the plate-shaped member, the pair of the connecting parts being configured to connect the pair of the clamping parts; and an inner lining member comprising a first portion and a pair of second portions, the first portion being disposed on a surface of one of the pair of the connecting parts proximal to the plate-shaped member, and each of the pair of the second portions being disposed on a surface of one of the pair of the clamping parts facing the other of the pair of the clamping parts, respectively, wherein the clamping parts and the connecting parts are configured to form an accommodation groove for accommodating a corner of a plate-shaped member, such that the clamping parts and the connecting parts are capable of covering a corner of a plate-shaped member, the second portions of the inner lining member are configured to be connected to each other and formed integrally, and an outer protection layer which covers the inner lining member, wherein materials of the outer package member and the inner lining member have different elastic coefficients.

2. The packaging assembly according to claim 1, wherein the elastic coefficient of the outer package member is larger than that of the inner lining member.

3. The packaging assembly according to claim 1, wherein the inner lining member and the outer package member covering thereon are formed integrally.

4. The packaging assembly according to claim 1, wherein inner walls of the pair of clamping parts of the outer package member have different areas.

5. The packaging assembly according to claim 1, wherein an area of the second portion of the inner lining member is equal to or smaller than that of an overlapping part between the clamping part of the outer package member and the plate-shaped member.

6. The packaging assembly according to claim 1, wherein the outer package member includes expandable polystyrene.

7. The packaging assembly according to claim 1, wherein the inner lining member includes expandable polystyrene.

* * * * *